US005350928A

United States Patent [19]

Hatchell et al.

[11] Patent Number: 5,350,928

[45] Date of Patent: Sep. 27, 1994

[54] APPARATUS AND METHOD FOR DETECTING PERFORATIONS

[75] Inventors: Peter J. Hatchell, New Franken; Danford C. Anderson, Green Bay; Ronald L. Lotto, Bonduel, all of Wis.

[73] Assignee: FMC Corporation, Chicago, Ill.

[21] Appl. No.: 16,340

[22] Filed: Feb. 11, 1993

[51] Int. Cl.[5] ..... G01N 21/86

[52] U.S. Cl. ..... 250/548; 225/100

[58] Field of Search ..... 250/561, 562, 571, 572, 250/548, 557; 235/458; 225/100, 106

[56] References Cited

U.S. PATENT DOCUMENTS

| | | | |
|---|---|---|---|
| 4,172,553 | 10/1979 | Feather et al. | 235/458 |
| 4,284,221 | 8/1981 | Nagel et al. | 225/100 |
| 4,454,973 | 6/1984 | Irvine | 225/100 |
| 4,618,085 | 10/1986 | Kimura et al. | 225/100 |

*Primary Examiner*—David C. Nelms
*Assistant Examiner*—K. Shami
*Attorney, Agent, or Firm*—Henry C. Query, Jr.; Richard B. Megley

[57] ABSTRACT

An apparatus for use in a system for making bags or the like from a continuous web or sheet of film material, the system including a perforator for imparting series of transverse perforations onto the web at regularly spaced intervals, which comprises a spreader roll having a reduced diameter portion between two enlarged diameter portions; a switch device located adjacent the reduced diameter portion; wherein the large diameter portions cause each series of perforation to pull apart and form a gap as the web is drawn over the spreader roll; and wherein the switch device is capable of being activated each time a gap passes in close proximity to the switch device.

4 Claims, 2 Drawing Sheets

18
W
14
10
18
W
28
30
23
22
20
12
16
L
32

APPARATUS AND METHOD FOR DETECTING PERFORATIONS

BACKGROUND OF THE INVENTION

1. Field of the invention

This invention relates generally to machines for making bags or the like from a continuous web or sheet of film material, such as plastic. More particularly, the invention relates to an apparatus and method for detecting perforations imparted onto the web at regularly spaced intervals.

2. Description of Related Art

Bag making machines are well known in the art. These machines typically include a sealing drum for imparting transverse seals onto the web material to thereby define individual plastic bags, a folding board section for folding the bags one or more times in the longitudinal direction, and a perforator for imparting series of perforations to the web adjacent the seals so that the individual bags may subsequently be separated from the web. After passing through the bag making machine, the web is usually directed through a bag winding machine, wherein the sealed and perforated web is rolled up into individual rolls consisting of a predetermined number of bags. Some prior art bag winding machines comprise a web separating apparatus for either separating the web at a particular series of perforations after a predetermined number of bags has been rolled up or separating the web at each series of perforations. Such a bag winding machine is disclosed in U.S. Pat. No. 5,161,793 issued to Lotto et al., in which the web separating apparatus comprises a pair of infeed rolls and a pair of nip rolls located a short distance downstream of the infeed rolls. The nip rolls are driven at a speed slightly greater than the infeed rolls and are normally not in contact with each other. When it is desired to separate the web at a particular series of perforations, the nip rolls are brought into contact with each other and the portion of the web caught between the nip rolls is pulled away from the portion of the web caught between the infeed rolls until the web consequently separates at the series of perforations. In addition, in the type of bag winding machine disclosed in Lotto et al., as each bag is being separated from the web, it passes into an interleaving or overlap forming zone, wherein the trailing edge of a leading bag is overlapped with the leading edge of the following bag. The interleaving zone comprises an air flow delivery manifold and a vacuum manifold operating in conjunction with either another air flow delivery manifold, a vacuum box or a mechanical loop former to direct the trailing edge of the leading bag and the leading edge of the following bag into an overlapping arrangement.

In prior art bag winding machines such as described above, the actuation of the web separating apparatus and the various interleaving devices must be precisely timed so that the web can be processed at high speeds. In addition, the actuation of these elements is dependent upon the position of the series of perforations. For example, the web separating apparatus will be actuated when the series of perforations is located between the infeed rolls and the nip rolls. Thus, knowing the positions of the series of perforations as the web passes through the bag winding machine is very important to the proper operation of the bag winding machine. In some prior art bag making systems, the position of a particular perforation in the bag winding machine can be estimated, provided the position of the perforation in the bag making machine and the distance between the bag making machine and the bag winding machine are known. However, when the distance between the bag making machine and the bag winding machine is great, as is often the case in dual lane systems wherein two webs are fed from a single bag making machine to two separate bag winding machines, the web can stretch and billow to such an extent that the position of the series of perforations cannot accurately be determined from the distance between the bag making machine and the bag winding machine.

One prior art device addresses this problem by attempting to detect the series of perforations as the web passes into the bag winding machine. This device uses electric leads on each side of the web to pass an electric arc through the perforation in the series and thereby complete a circuit each time a series of perforations passes by. The disadvantages of this device are that the web must travel relatively slowly due to switching frequency limitations (around 8 Hz) and, even at this slow speed, the individual perforations may not always provide the opening required to pass the electric arc. Therefore, both the production rates and the detection accuracy are low in systems employing this device.

SUMMARY OF THE INVENTION

Therefore, it is an object of the present invention to provide a means and method of precisely locating the positions of the series of perforations as the web enters the bag winding machine. It is another object of the present invention to provide such a means and method which will detect the series of perforations even at high speeds and will simultaneously ensure a high detection rate.

According to the present invention, these and other objects and advantages are achieved by providing a bag winding machine with a spreader roll assembly comprising a spreader roll for separating a portion of the web at each series of perforations and switch means for detecting the resulting separation. The spreader roll comprises a reduced diameter portion located between two enlarged diameter portions. The switch means is preferably a photoswitch, but can be any appropriate type switch, such as a mechanical contact switch or a pneumatic switch, and is located adjacent the reduced diameter portion of the spreader roll. In operation, as the web is drawn over the spreader roll, the enlarged diameter portions of the spreader roll will cause the web to separate along a small portion of the series of perforations, thereby creating a gap in the series of perforations that can be detected by the switch means. In a preferred embodiment of the invention, the perforator in the bag making machine is designed to provide a small slit in each series of perforations which can more easily be separated by the spreader roll. The present invention can, of course, be employed in any system or machine wherein the detection of perforations or similar means may be appropriate.

These and other objects and advantages of the present invention will be made apparent from the following detailed description, with reference to the accompanying drawings.

DETAILED DESCRIPTION OF THE PREFERRED EMBODIMENTS

Figure 1:
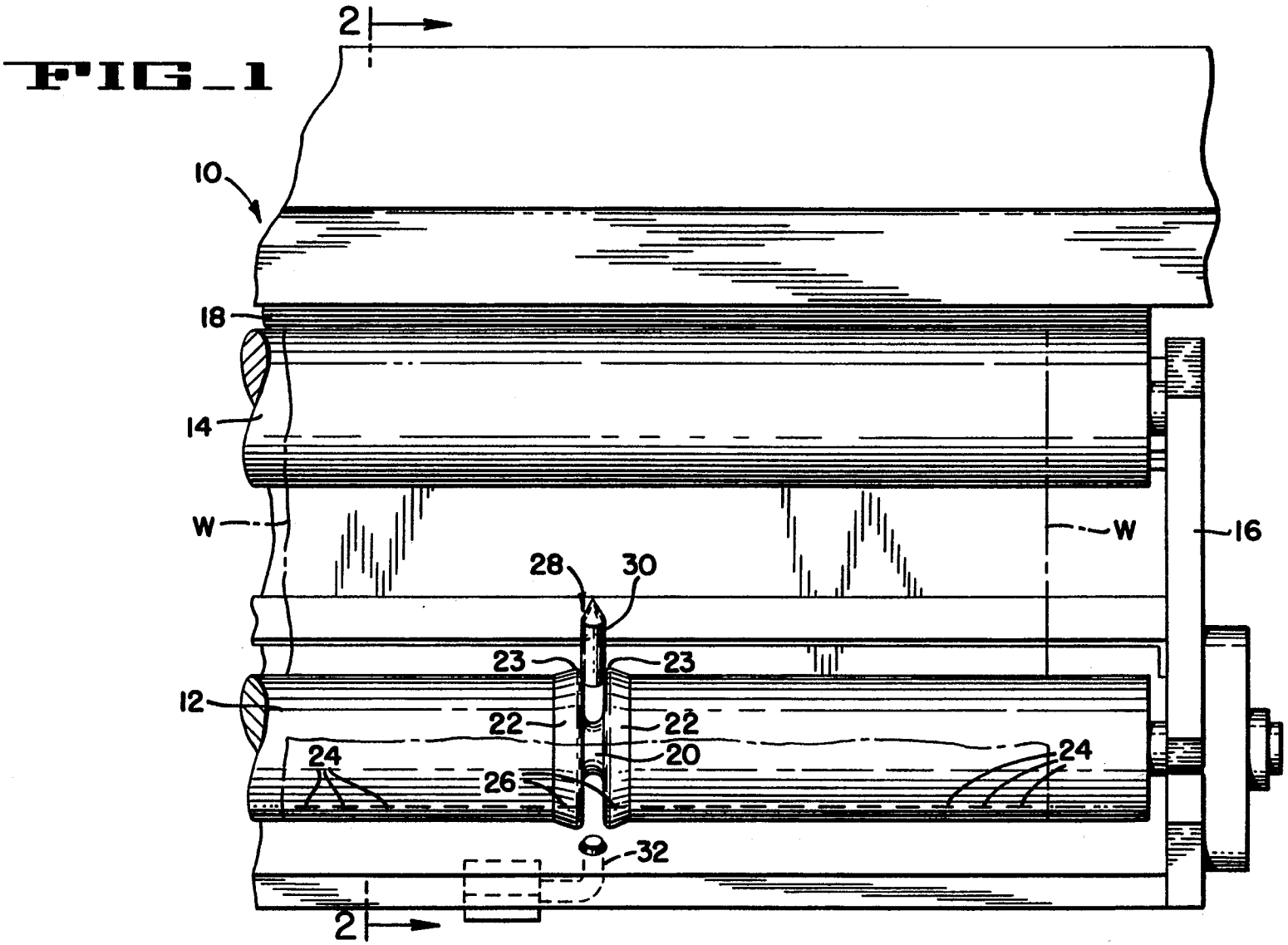
FIG. 1 is a partial front elevation view of the spreader roll assembly of the present invention, also showing a separation in the web at a particular series of perforations.
Figure 2:
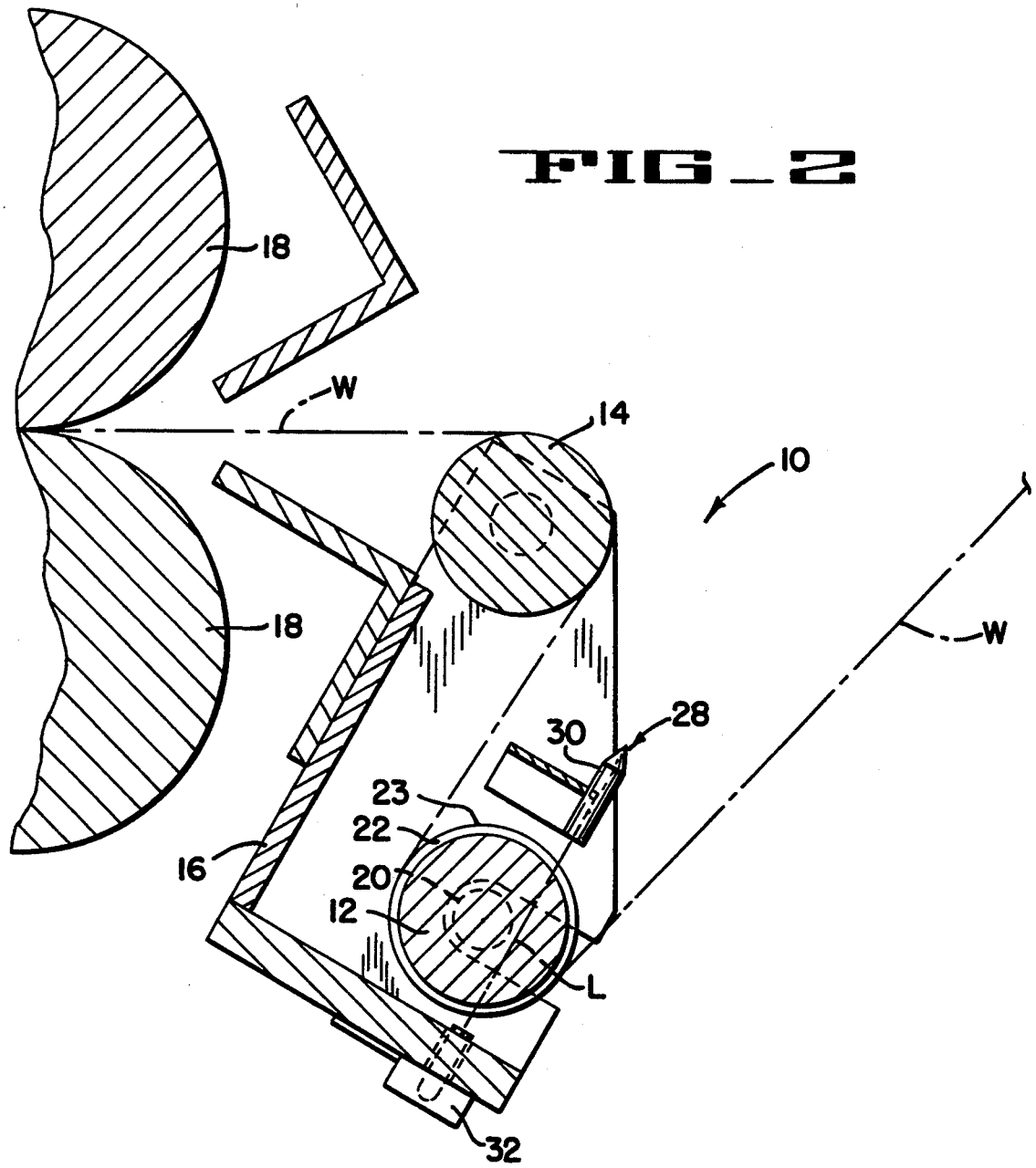
FIG. 2 is a side elevation view of the spreader roll assembly taken along line 2—2 of FIG. 1, also showing the spreader roll assembly mounted onto structure of a bag winding machine.

Referring to FIGS. 1 and 2, the spreader roll assembly, indicated generally by reference numeral 10, is shown to comprise a spreader roll 12 and a guide roll 14, each rotationally mounted in a frame member 16. The spreader roll assembly 10 is shown in FIG. 2 to be mounted at the inlet portion of a bag winding machine, such as is depicted in the aforementioned U.S. Pat. No. 5,161,793, just upstream of the infeed rolls 18. In this arrangement, a web of material W is drawn from a bag making machine (not shown) over spreader roll 12, around guide roll 14 and between the infeed rolls 18. While the above describes the preferred manner of incorporating the present invention into a bag making system, it should be understood that it is not necessary that spreader roll 12 be mounted in a frame member with a guide roll or that spreader roll 12 be mounted in the bag winding machine just upstream of the infeed rolls. The practice of the present invention merely requires that spreader roll 12 be positioned in a bag making system such that enough tension will be created in web W as it is drawn over spreader roll 12 to create a separation in web W at each series of perforations sufficient to enable activation of the switch means, as will be described.

Referring again to FIG. 1, spreader roll 12 is shown to comprise a reduced diameter portion 20 located between two enlarged diameter portions 22. The enlarged diameter portions 22 operate to create tensile stresses in web W in the area of enlarged portions 22 as web W is being drawn over spreader roll 12. Preferably, enlarged diameter portions 22 are formed with annular tapered crowns 23, which operate to create a greater degree of tension in web W. These stresses cause web W to pull apart or separate at each perforation 24 to create a small gap or opening 26 in web W. Preferably, the perforator of the bag making machine (not shown) is designed so that a small slit, approximately one inch long, is formed in web W as part of each transverse perforation so that web W may more easily be pulled apart to form gap 26.

Referring to both FIGS. 1 and 2, spreader roll assembly 10 further comprises a switch means 28 mounted to frame member 16 adjacent reduced diameter portion 20 of spreader roll 12. While switch means 28 can be any type of switch that is capable of detecting a gap in a web of material, such as a photoswitch, a mechanical contact switch or a pneumatic switch, in the embodiment depicted in the drawings, switch means 28 is an opposed beam fiber optic photoswitch comprising a light transmitter 30 and a light receptor 32. Switch means 28 is positioned on frame 16 such that the path of a light beam L between transmitter 30 and receptor 32 will pass through the opening in spreader roll 12 surrounding reduced diameter portion 20. Thus, as web W is drawn around spreader roll 12, switch means 28 will be activated when beam L passes through gap 26. Similarly, in embodiments of the invention wherein switch means 28 is a mechanical contact switch or a pneumatic switch, switch means 28 will be activated when a switch element contacts gap 26 or a flow of air is transmitted through gap 26, respectively.

In operation, as web W is drawn over spreader roll 12, the tension caused by enlarged diameter portions 22 will cause web W to separate and create a small gap 26 at each series of perforations. As gap 26 passes in proximity to switch means 28, switch means 28 will be activated. For example, in the embodiment of switch means 28 depicted in the drawings, as gap 26 passes in proximity to switch means 28, light beam L emanating from transmitter 30 will pass through gap 26 and trigger receptor 32 to thereby activate switch means 28.

In order to track the position of each series of perforations, switch means 28 is preferably electrically connected to a computer or similar processing means which also receives input from a rotary encoder connected to, for example, the shaft of one of the infeed rolls. In this arrangement, the computer can be programmed to begin tracking the number of pulses generated by the encoder each time switch means 28 is activated and actuate the web separation and interleaving devices after a corresponding number of pulses is received from the encoder. Thus, the actuation of these devices is dependent upon the exact position of each series of perforations, which in turn is determined by the number of pulses generated by the encoder from the time switch means 28 signals the computer. In this manner, the timing of the selective actuation of the web separator and each interleaving device can be precisely controlled.

It should be recognized that, while the present invention has been described by reference to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. An apparatus for use in a system for making bags from a continuous web or sheet of film material, the system including means for imparting series of transverse perforations onto the web at regularly spaced intervals, which comprises:

a spreader roll having a reduced diameter portion between two enlarged diameter portions;

wherein the enlarged diameter portions cause a portion of each series Of perforations to pull apart and form a gap as the web is drawn over the spreader roll; and switch means located adjacent the reduced diameter portion for detecting each gap.

2. The apparatus of claim 1, wherein the switch means is a photoswitch.

3. A method of detecting series of perforations imparted onto a continuous web or sheet of film material at regularly spaced intervals which comprises:

spreading the web apart to form a small gap at each series of perforations; and detecting each gap.

4. The method of claim 3, further comprising the step of initially forming a slit in each series of perforations.

* * * * *